United States Patent [19]

Reysman

[11] Patent Number: 4,552,542

[45] Date of Patent: Nov. 12, 1985

[54] SPINNING DISC TOY

[76] Inventor: Marjan Reysman, 49 Jack Rd., Williamsville, N.Y. 14221

[21] Appl. No.: 668,971

[22] Filed: Nov. 7, 1984

[51] Int. Cl.[4] ..... A63H 1/32

[52] U.S. Cl. ..... 446/254; 446/242; 446/485

[58] Field of Search ..... 446/253, 254, 242, 247, 446/485

[56] References Cited

U.S. PATENT DOCUMENTS

| | | | |
|---|---|---|---|
| 2,623,327 | 12/1952 | Testino | 446/242 |
| 2,739,419 | 3/1956 | Cleveland | 446/253 |
| 2,841,922 | 7/1958 | Kolintzas | 446/253 |
| 3,131,506 | 5/1964 | Fox | 446/253 |
| 3,162,979 | 12/1964 | Garoogian | 446/242 |
| 3,531,892 | 10/1970 | Pearce | 446/242 |
| 3,924,114 | 12/1975 | Sanchez | 446/242 |

FOREIGN PATENT DOCUMENTS

| | | | |
|---|---|---|---|
| 2051332 | 4/1972 | Fed. Rep. of Germany | 446/242 |
| 2551699 | 6/1977 | Fed. Rep. of Germany | 446/253 |
| 703781 | 2/1954 | United Kingdom | 446/242 |
| 1032320 | 6/1966 | United Kingdom | 446/242 |

OTHER PUBLICATIONS

Zun Zun 3/4/84, Prior Art Discovered by Applicant During a Trip Abroad on Mar. 4 & 5, 1984.

*Primary Examiner*—Robert A. Hafer
*Assistant Examiner*—Daniel Nolan
*Attorney, Agent, or Firm*—James J. Ralabate

[57] ABSTRACT

An illuminating spinning toy in the form of a disc which may be rotated by twisted cords extending through openings in the disc. The device is formed of two halves which when attached, form an internal battery and light bulb compartment. Within this compartment is located a security bar which may be locked across the compartment to hold the internal elements in a stationary, secure position. A centrifugal switch is also located within the compartment to cause the light to be illuminated when the disc is rotated.

9 Claims, 4 Drawing Figures

Fig. 1
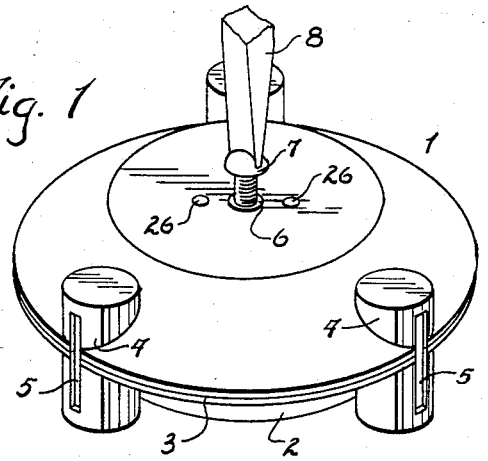
Fig. 2
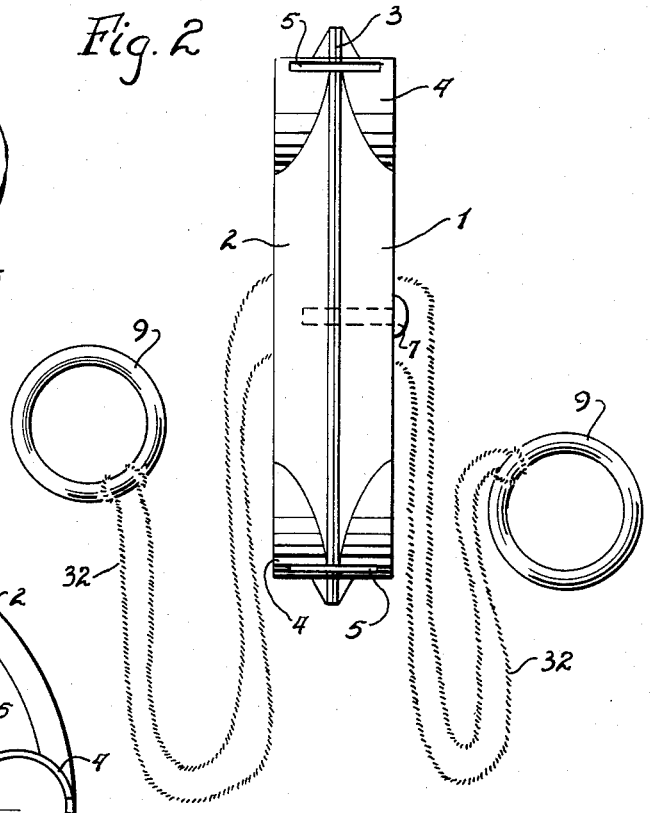
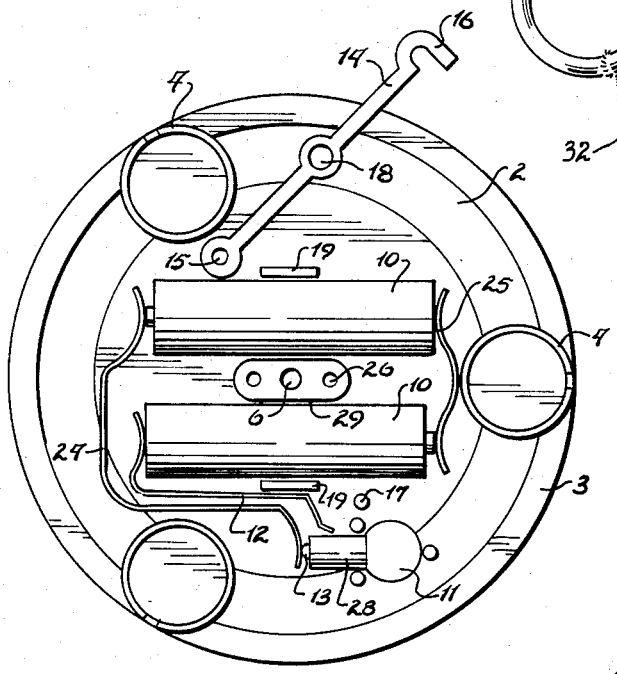
Fig. 3
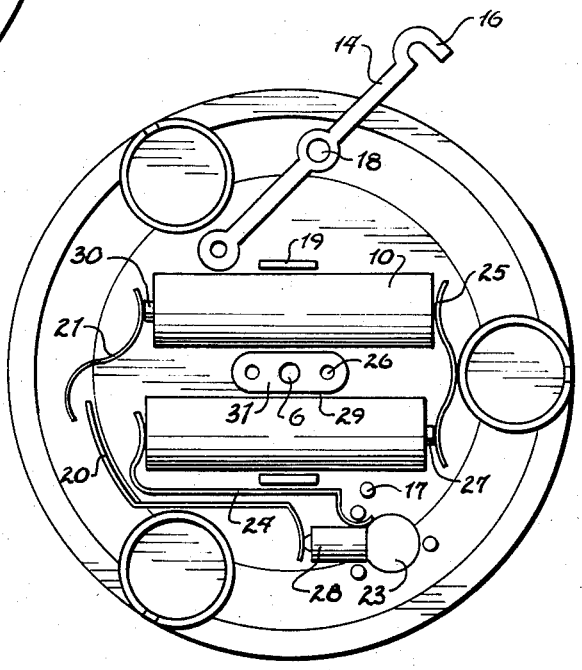
Fig. 4

SPINNING DISC TOY

This invention relates to a children's toy and, more specifically, to a battery-powered toy that can be lighted when spun.

BACKGROUND OF THE INVENTION

It is known to provide various battery-operated toys that can be lighted when operated in various ways. Spinning toys which can be illuminated during the spinning operation are also known including tops and yo-yo type toys. In U.S. Pat. No. 1,762,620 a toy that spins along a string as it moves is disclosed but this device does not provide means of illumination. While the toy disclosed in this prior art patent is a spinning disc, it not only does not illuminate but also travels up and down a string. In U.S. Pat. No. 3,646,703 a spinning top which is string activated is disclosed. This top contains a friction disc and flints which when rotated produce sparks within the top that are visible. Again, this top toy is not a disc that rotates or spins along a string axis nor is it battery operated. In U.S. Pat. No. 4,277,912 a gyroscope toy that is battery powered is disclosed. This prior art toy provides batteries that drive a motor for rotation and uses the battery also for flashing lights.

The closest prior art known involves a device disclosed by the reference Zun-Zun Internacional-Industria e Comercio de Brinquedos e Utilidades Domesticas Ltda. and cited in the Disclosure Statement filed herewith. This illustrated device is a spin disc toy comprising two plate-like sections. These sections may be pried apart through an aperture provided in the peripheral portion of one of the sections. The inner portion of the device contains battery chambers and circuit connectors or connecting means that electrically connect batteries to a bulb. One of the metal connectors or circuit lead runs from a terminal of a battery to a position almost in contact with the bulb. When this toy disc is spun by pulling and maneuvering of the strings this metal or circuit lead contacts the bulb and lights up the toy. The rotation of the disc toy by the activation and spinning action caused by the strings, causes the circuit lead by centrifugal force to come in contact with the bulb. This centrifugal force causes the electrical circuit to be closed and the bulb illuminated. While this toy is attractive and enjoyable for children it also creates the dangerous possibility of the disc parts separating and spinning off with the potential of injuring the user or a spectator. In use the batteries can easily become detached from the structure and fly out of the toy. It is believed that each of these dangers have to some extent limited the use and commercial success of this toy.

SUMMARY OF THE INVENTION

It is therefore an object of this invention to provide an illuminable spinning disc toy devoid of the above-noted disadvantages.

Another object of this invention is to provide a spinning toy that is easy to use and adapted for use by children.

A further object of this invention is to provide a battery-operated spinning toy that can be illuminated and that will whistle upon spinning.

Another further object of this invention is to provide a spinning toy that is substantially safe for the user including children.

Still another object of this invention is to provide an entertaining and educational toy for children.

Another still further object of this invention is to provide a spinning toy that is relatively simple and economical to manufacture.

Yet still another object of this invention is to provide an entertaining, illuminating device that may be used by people of all ages especially in darkened areas where the appeal of an illuminated toy is more apparent.

The foregoing objects and others are accomplished in accordance with this invention by providing a safe and effective spinning toy. This toy has two main plate-like sections each capable of mating with the other when joined and assembled. In the interior of the toy formed by the joining together of these sections is located a power chamber that is adapted to house one, two or a plurality of primary batteries. While reusable batteries can be used, it is preferred to use conventional small flashlite type batteries that are disposable. These batteries are electrically connected together and have a flexible lead or circuit connector that in one embodiment extends from the batteries to close proximity to the bulb. When the toy is activated or spun, the centrifugal force imparted causes this flexible lead to contact the bulb or battery and illuminate the device. While this force causes the lead to move it may, without a safety device, dislodge the contents of the toy such as batteries, bulbs or metallic leads. Also, the two half-discs or plate-like sections can easily separate in use and spin off from the device.

To prevent these substantially dangerous use effects the present device has been provided. It comprises safety means for securing the batteries in place and preventing the possibility of them being dislodged when the toy is spinning. The preferred securing means preferably involves a substantially rigid plastic or otherwise rigid non-conducting safety bracket that can movably connect to a fixed position over said batteries. A metallic safety bracket can be used if proper care is made to prevent it from interfering with the interior circuit. This securing means not only retains the substantially heavy batteries in place but also maintains the positioning of the metal contacts and leads in place except, of course, for the flexible circuit connector. However, the batteries being substantially heavy are the most likely to become dislodged and also become the most dangerous if dislodged. Thus means are preferably provided both internally and externally to maintain the contents of the toy interior in position. The internal content securing means is preferably in the form of a movable rigid plastic hook that pivots at one end and upon a terminal focal piece and is adapted to lock into an attachment means at its opposite terminal end. The external content securing means is preferably in the form of a screw or bolt that is adapted to be threaded through at least portions of both disc-halves thereby connecting them together. This screw also extends through the center portion of the internal securing means thus providing bonus additional strength to this structure. While the internal securing means is illustrated in the drawings as a narrow single linear structure it may be in the form of any suitable securing means such as an X-form that would extend over most of the contents. It is important, however, that the interior securing means satisfactorily hold the batteries in position and prevent dislodging and be adapted to cooperate with the external securing means to provide an additional measure of security.

In lieu of the flexible lead or contact being designed so that it contacts the bulb upon spinning of the toy device to close the circuit and illuminate the device, it can be made to contact a battery terminal to close the circuit and illuminate the device. In other words, in one embodiment all electrical circuit contacts will be in place except for the lead from the bulb to one of the terminals. This lead may be left open at either end, either the end adjacent the bulb or the end adjacent the terminal. The spinning of the toy disc provides the energy or force to cause centrifugal force upon the flexible lead and cause contact with the electrical component (bulb or battery) required to close the circuit.

BRIEF DESCRIPTION OF THE DRAWING

FIG. 1 is a front sectional view of the toy of the invention.

FIG. 2 is a side sectional view of the toy of the invention.

FIG. 3 is a plan view of the interior of an embodiment of the toy of this invention with one disc-half removed and showing a flexible contact adjacent the bulb.

FIG. 4 is a plan view of the interior of an embodiment of the toy of this invention with one disc-half section removed and showing a flexible contact adjacent the battery terminal.

DESCRIPTION OF DRAWING AND OF THE PREFERRED EMBODIMENTS

In FIG. 1 the toy of this invention is shown having two disc-half sections 1 and 2. These sections fit into each other at their peripheries 3 to form a disc-like toy. This toy is similar to a device that would be formed if two plastic or shallow bowls were attached together at their circumferential open faces to form a disc-like structure. Around the peripheral portion of at least one half section 1 or 2 are optionally located whistling portions 4 that may be in the form of cylindrical sections that have openings 5 to create the whistling sound when the device is spinning. Positioned in substantially the center of the toy and extending through both disc-half sections 1 and 2 is central aperture 6 which is adapted to receive and house a connecting bolt or screw 7 which may be tightened or loosened by screw drive 8 or other suitable means. The sections 1 and 2 may be made from any suitable transparent or translucent material such as plastic or other synthetics. Typical plastics are polystyrene materials, polyvinyl materials, polyacrilates, polyurethanes, polycarbonates, mixtures thereof or any other suitable materials that will transmit light. Preferably, the material should be shatterproof for safety considerations. The cylindrical sections 4 not only provide sound effects for the toy but also impart dimensional stability to the device. This is important since both sections 1 and 2 must mesh or mate when connected by bolt or screw 7 in the outer securing means.

In FIG. 2 sections 1 and 2 are shown after they have been connected by screw 7. The screw may extend through all of both sections 1 and 2 or may extend only partially through as illustrated. Strings 32 are fixed and located in the side portions of sections 1 and 2 at string holes 26 and terminate at their opposite ends around finger rings 9. The child using the toy merely puts his or her fingers through finger rings 9 and alternately pulls and relaxes the tension on strings 32. This causes the toy to spin and illuminates the device as will be described in later reference to FIGS. 3 and 4. Cylindrical sections 4 are illustrated having apertures 5 which create the whistle when the toy is spinning. Sections 4 may be located in only one of the half-disc sections 1 or 2 if desired rather than in both as illustrated.

In FIG. 3 the inner portion of the spinning toy is illustrated with one section 1 or 2 removed. Either section 1 or 2 may contain the power chamber which houses batteries 10 and bulb 11. The batteries 10 are electrically connected in any conventional or known manner. Bulb 11 has a flexible lead 12 which is in proximity to it but not quite in contact with bulb stem 28. As the toy is spun by pulling and relaxing of strings 8, flexible lead 12 is moved outwardly away from the center of the axis of section 1 and contacts the end 13 of bulb 11 (or stem 28 as illustrated) thus closing the circuit and lighting up the toy. A battery stabilizing bar 14 is provided as an inner securing means to lock batteries 10 in position and prevent them from spinning out from their normal position. This bar 14 is preferably constructed from a non-conducting material so that it will not interfere with the electrical circuit of the toy. Bar 14 is movably and pivotly connected at one end to a bar anchor 15 around which it can rotate or move. At the other end of bar 14 is a hook 16 that is adapted to hook into and lock with hook catch 17. Hook catch 17 is illustrated as a small projection, but preferably is a nail head type catch that will securely lock with hook 16 when engaged. In the center portion of bar 14 is an opening or eyelet 18 adapted to receive screw 7 when sections 1 and 2 are connected together as shown in FIG. 1. Screw 7 is threaded through aperture 6 and eyelet 18 which are aligned in the toy when sections 1 and 2 are connected as in FIG. 1. Thus, not only is bar 14 fixed into position by hook 16 locked with catch 17, but also additionally secured by screw 7 which passes through eyelet 18 when the device or toy is completely assembled as shown in FIG. 1. Plastic battery holds 19 may be used to define the battery compartment and further secure the batteries in position. These holds 19 prevent the side to side movement of batteries 10. The outer longitudinal portion of batteries 10 abut against holds 19 while the inner longitudinal portions abut the outer raised wall 29 of the outer structure 31 containing central aperture 6. Thus, the batteries are held firm by holds 19, by raise aperture walls 29, by stabilizing bar 14 and by screw 7 as it is tightened about bar eyelet 18. In lieu of flexible lead 12 contacting the bulb to close and complete the electrical circuit and illuminate the toy upon spinning (as illustrated in FIG. 3), the flexible lead can be made to contact a battery terminal or terminal lead or connection.

In FIG. 4 an embodiment of this invention is illustrated wherein a flexible lead 20 contacts a conductive battery conducting means 21. Conducting means 21 may be electrically connected to a terminal 30 of a battery. Upon spinning the centrifugal force imparted will cause flexible lead 20 to move outwardly, ultimately in contact with conducting means 21. This would complete the circuit since conducting means 21 is in electrical connection with battery terminal 30 via connecting means 21. Each of these elements 20 and 21 are made from suitable electrical conducting metal such as copper. Flexible lead 20 is generally a thin foil-like metal strip that is capable of bending upon exertion of centrifugal force. Once flexible lead 20 touches conductor 21 which is in electrical connection with the remainder of the circuit, bulb 23 will be illuminated. Circuit connecting means such as 24 and 25 are made from conventional electrical conducting metals similar to those used in a flashlight or battery run toys. String holes 26 permit the string to be secured to both sections 1 and 2 so that the toy can be operated.

While it is preferred to utilize all of the securing means to keep the inner contents such as batteries from spinning or flying out of the toy, it is critical that at least the outer securing means utilizing screw 7 be used. In the preferred embodiment both outer securing means with screw 7 and inner securing means with bar 14 are used. All outer parts such as disc-like sections 1 and 2 are constructed of a transparent plastic. All circuit connecting means internally are constructed of conventional electrically conducting materials such as metals, metals in plastic, etc.

The preferred and optimumly preferred embodiments of the present invention have been described herein and shown in the accompanying drawing to illustrate the underlying principles of the invention, but it is to be understood that numerous modifications and ramifications may be made without departing from the spirit and scope of this invention.

What is claimed is:

1. A string-activated illuminable spin disc toy comprising two half-disc sections complementary to each other, a battery and bulb compartment securing means, and string-activating means attached to both of said half-disc sections, one of said sections containing in its interior portion said battery and bulb compartments, said securing means comprising an inner and outer securing means, said outer securing means comprising a centrally positioned annular conduit extending transversely through at least a portion of both of said sections and adapted to receive therethrough a bolt means thereby connecting said half-disc sections together to form a disc-like toy, said inner securing means comprising a movable bar adapted to be moved and locked into position over substantially the width of said battery compartment, said inner securing means comprising a substantially centrally located aperture aligned with said conduit to receive said bolt.

2. The toy of claim 1 wherein said inner securing means comprises a security bar that is adapted to be moved into a locked position diagonally across said battery and bulb compartment thereby preventing said batteries in said compartment from moving out of their original position.

3. The toy of claim 1 wherein said battery and bulb compartment contains a security bar that is adapted to be moved into a locked position diagonally across said compartment and thereby preventing any elements in said compartment from moving out of their original position and wherein said bolt means extends through said security bar to impart thereto an additional locking effect to said bar.

4. The toy of claim 1 wherein said inner securing means comprises a movable bar adapted to lock with a bar catch, said bar in its locked position extends over at least a portion of all batteries contained in said toy and comprises an eyelet through which said bolt passes when said sections are in a fixed final configuration.

5. The toy of claim 1 wherein sound means are provided which are activated upon spinning of said toy.

6. The toy of claim 1 wherein illuminating means are provided which become activated upon a spinning of said toy, said illuminating means comprising a bulb, at least one battery and flexible circuit closing means, said flexible means adapted to move and close a circuit which causes said bulb to become lighted.

7. The toy of claim 1 wherein strings are attached to each of said sections at one end, and attached to finger rings at their opposite end.

8. The toy of claim 1 wherein the toy becomes illuminated when a flexible conductor contacts a battery terminal therein.

9. The toy of claim 1 wherein the toy becomes illuminated when a flexible conductor contacts the bulb therein.

* * * * *